US005899225A

United States Patent [19]

Yokogi

[11] Patent Number: 5,899,225

[45] Date of Patent: May 4, 1999

[54] AIR TUBE CONNECTION STATE DETECTING APPARATUS

[75] Inventor: Kazuo Yokogi, Hyogo-ken, Japan

[73] Assignee: Teisan Kabushiki Kaisha, Tokyo, Japan

[21] Appl. No.: 08/998,228

[22] Filed: Dec. 24, 1997

[30] Foreign Application Priority Data

Dec. 27, 1996 [JP] Japan ..... 8-350697

[51] Int. Cl.[6] ..... F01B 25/26

[52] U.S. Cl. ..... 137/551; 137/559; 92/5 R

[58] Field of Search ..... 137/551, 559; 92/5 R

[56] References Cited

U.S. PATENT DOCUMENTS

| | | | |
|---|---|---|---|
| 2,435,343 | 2/1948 | Downey | 92/5 R |
| 3,431,031 | 3/1969 | Ike | 92/5 R |
| 5,145,331 | 9/1992 | Goes et al. | 92/5 R |

FOREIGN PATENT DOCUMENTS

| | | | |
|---|---|---|---|
| 1017433 | 10/1957 | Germany | 137/551 |

*Primary Examiner*—A. Michael Chambers
*Attorney, Agent, or Firm*—Burns, Doane, Swecker & Mathis, L.L.P.

[57] ABSTRACT

The present invention is intended to provide an apparatus capable of detecting an air tube-detached state when said air tube has been detached from an air-actuated valve in order that the same air-actuated valve is caused to assume a closed state. The present invention relates to an air tube connection state detecting apparatus 10 for detecting whether the fore end of an air tube 56 for supplying compressed air to an air-actuated valve 16 for a gas container 12 is connected to said air-actuated valve 16 or not. The air tube connection state detecting apparatus comprises a to-be-contacted member 82, provided at a predetermined position separate from said air-actuated valve 16, to which the fore end of said air tube 56 is to be connected; and a detection means 86 for detecting that the fore end of said air tube 56 is connected to said to-be-connected member 82. If it is detected by the detection means 86 that the air tube 56 is connected to the to-be-connected member 82, in this construction, it can be recognized that the air tube 56 has been detached from the air actuated valve 16.

6 Claims, 4 Drawing Sheets

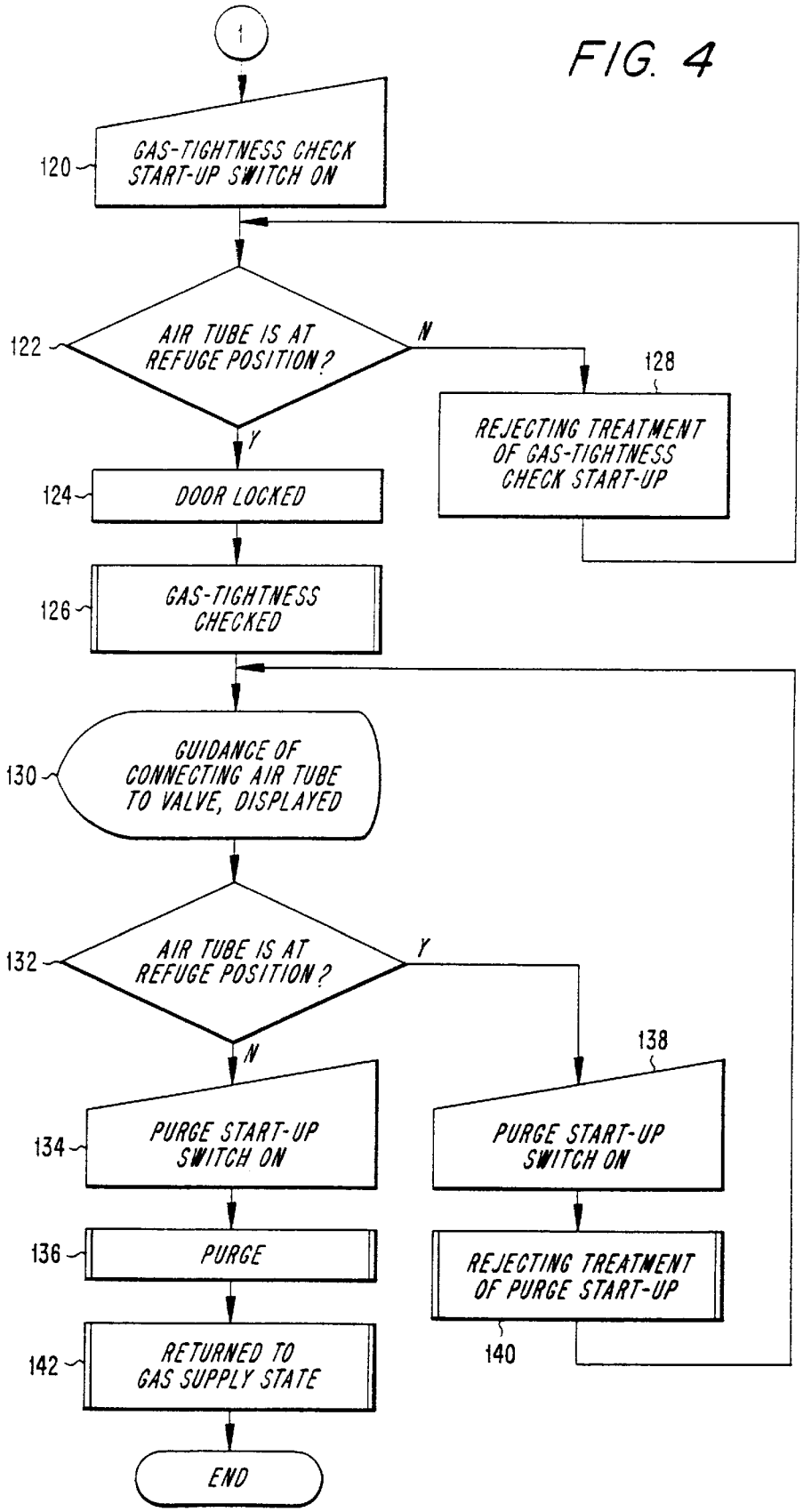
FIG. 4
1
120
GAS-TIGHTNESS CHECK START-UP SWITCH ON
122
AIR TUBE IS AT REFUGE POSITION?
N
128
REJECTING TREATMENT OF GAS-TIGHTNESS CHECK START-UP
Y
124
DOOR LOCKED
126
GAS-TIGHTNESS CHECKED
130
GUIDANCE OF CONNECTING AIR TUBE TO VALVE, DISPLAYED
132
AIR TUBE IS AT REFUGE POSITION?
Y
138
N
134
PURGE START-UP SWITCH ON
PURGE START-UP SWITCH ON
136
PURGE
REJECTING TREATMENT OF PURGE START-UP
140
142
RETURNED TO GAS SUPPLY STATE
END

AIR TUBE CONNECTION STATE DETECTING APPARATUS

BACKGROUND OF THE INVENTION

1. Field of the Invention

The present invention relates to an air-actuated valve of a gas container, and especially to an apparatus for detecting whether an air tube for applying a pneumatic pressure is connected to an air-actuated valve.

2. Description of Related Art

Spiral material gas for use in manufacture of semiconductors is usually stored in a portable gas container which is called "a gas bomb" or "a gas cylinder". Many special material gases for use in manufacture of semiconductors are dangerous gases which possess combustibility (explosiveness), toxicity, corrosiveness or combustion-supporting property. It is therefore necessary to take thoughtful consideration to their use in view of safety. Accordingly, a gas container filled with such a dangerous special material gas has hitherto been accommodated in a box having an exhaust duct to cope with a gas leakage in an emergency. This box is called "a cylinder cabinet".

When a gas container is accommodated in a cylinder cabinet, it is desired that the opening and closing operation of a valve on the gas container is automatically carried out by remote operation in view of safety. There have been hitherto used various valves capable of being handled under remote operation. A conventional valve of the remote operation type is an air-actuated valve. An air-actuated valve is opened or closed by moving a valve body by a pneumatic actuator. An air-actuated valve for a gas container is normally a closed type. It is constructed such that the valve is opened only when compressed air is supplied to the pneumatic actuator.

When a gas container is removed for exchange from a process line, the remaining gas in the line is purged to prevent the special material gas from leaking out of the line. This purging work must be carried when the valve of the gas container is closed. In the case of an air-actuated valve, the closing of said valve has hitherto been effected by stopping the supply of compressed air thereto. When an air tube is connected to an air-actuated valve, however, it is feared that compressed air will be supplied to the valve because of a manual operation mistake, or an air control circuit malfunction. Accordingly, the purging work is premised on the assumption that the air tube was previously detached from the air-actuated valve.

Since the detachment of an air tube is manual work carried out by an operator, the operator may forget to detach the air tube in error. Although there is, of course, no problem even in this case because it is devised that the supply of compressed air is automatically stopped in purge, it is desirable, from the viewpoint of multiplexing fail safe, to cope with a serious situation.

SUMMARY OF THE INVENTION

Due to consideration of the aforementioned facts, the present invention has been achieved. It is an object of the present invention to provide an apparatus capable of detecting a detached air tube when said air tube has been detached from an air-actuated valve so that the same air-actuated valve is closed.

In order to achieve the above-mentioned purpose, the present invention resides in an air tube connection state detecting apparatus for detecting whether the fore end of the air tube for supplying compressed air to an air-actuated valve for a gas container is connected to the air-actuated valve or not. The air tube connection stated apparatus desirably has a to-be-contacted member, provided at a predetermined position separate from the air-actuated valve, to which the fore end of the air tube is to be connected; and a detection means for detecting that the fore end of the air tube is connected to the to-be-connected member.

In a case where it is detected by a detection means that an air tube is connected to a to-be-connected member, in this construction, it can be recognized that the air tube has been detached from an air-actuated valve, and in a converse case, it can be recognized that there is the possibility that the air tube is connected to the valve.

It is conceived that the detection means comprises an air supply means for supplying air into the air tube through the to-be-connected member only when the fore end of the air tube is connected to the to-be-connected member, and an air supply detection means for detecting that air is supplied from the air supply means. Further, said detection means may be one using a photoelectric sensor.

Moreover, the air tube connection state detecting apparatus according to the present invention may further comprise a control mean for controlling a system related to said gas container on the basis of the results detected by said detection means. In a case where an air tube may possibly be connected to an air-actuated valve, the system may be controlled so that the purge step is not put into practice.

BRIEF DESCRIPTION OF THE DRAWINGS

FIG. 4 is a flow chart showing a portion of a program which is put into practice by the microcomputer in the apparatus according to the present invention, and this is continued from the flow chart of FIG. 3.

DETAILED DESCRIPTION OF THE INVENTION

Figure 1:
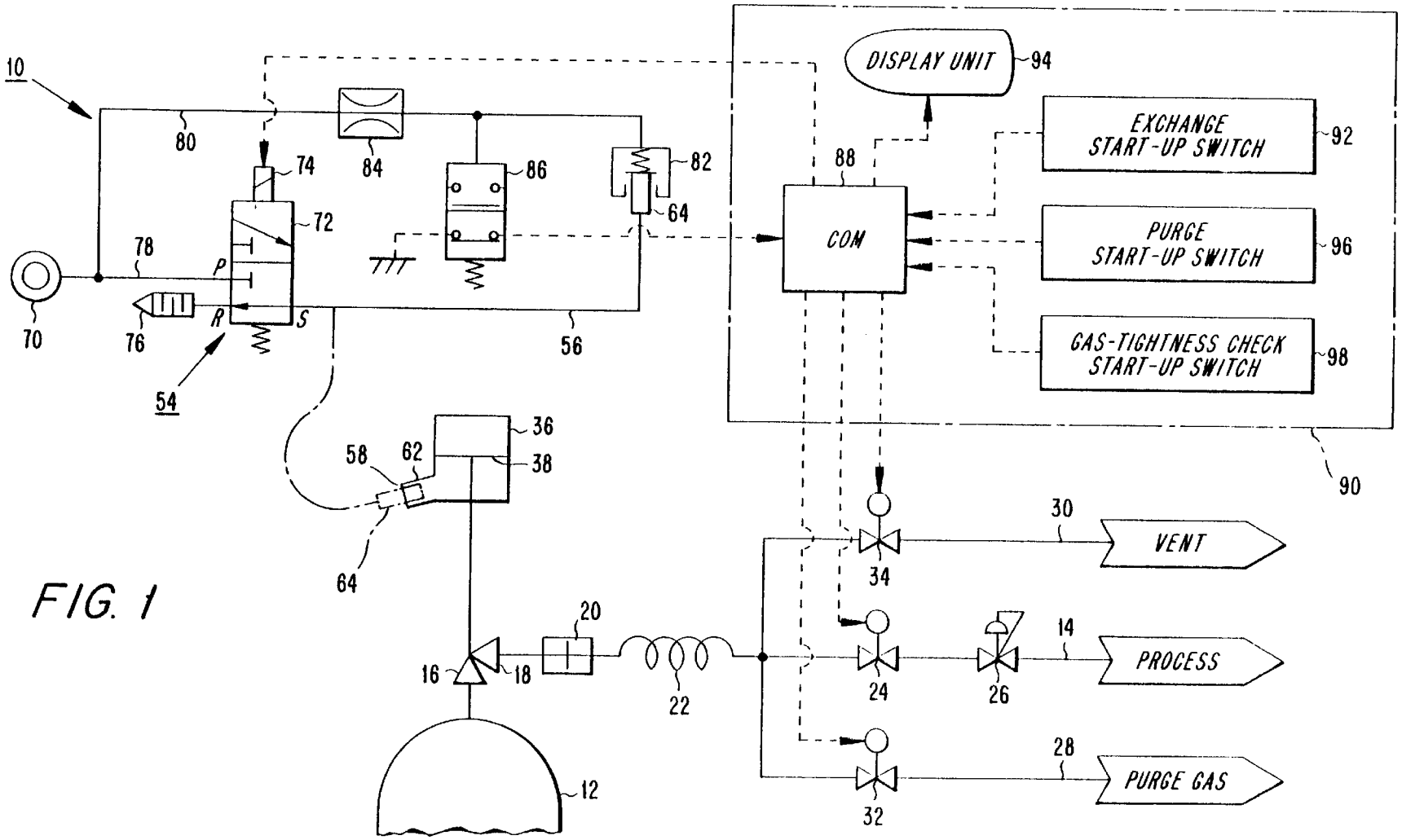
FIG. 1 is a rough view showing one embodiment of the present invention.

Now referring to the drawings, a preferred embodiment of the present invention will be described here. FIG. 1 shows a gas supply system, to which the air tube connection state detecting apparatus in accordance with the present invention is applied. This gas supply system is intended to supply a special material gas for manufacture of semiconductors, for example a silane series gas, stored in a gas container 12 to an appointed semiconductor-manufacturing unit (not shown). If explained in detail, the gas supply system of the illustrated embodiment has a pipe 14 as a process line for supplying such gas to the semiconductor-manufacturing unit. One end of this pipe 14 is removably connected to the discharge port 18 of a valve 15 attached on the mouth of the gas container 12 by means of a joint 20. In the pipe 14 are provided a heat exchanger 22 for raising the temperature of a gas to normal temperature, a shut-off valve 24 and a flow rate regulation valve 26, in order from the side of the valve 16. To this pipe 14, furthermore, two pipes 28, 30 are connected between the heat exchanger 22 and the shut-off valve 24. Pipe 28 supplies a purge gas such as nitrogen gas from a purge gas supply source. Pipe 30 vents the purge gas into the atmosphere. Pipes 28 and 30 have shut-off valves 32, 34 provided therein, respectively. Of course, the pipe 30 has a suitable exhaust gas treatment unit (not shown) provided therein for making harmless a special material gas. In addition, the gas container 12 is accommodated for safety in a cylinder cabinet (not shown).

Figure 2:
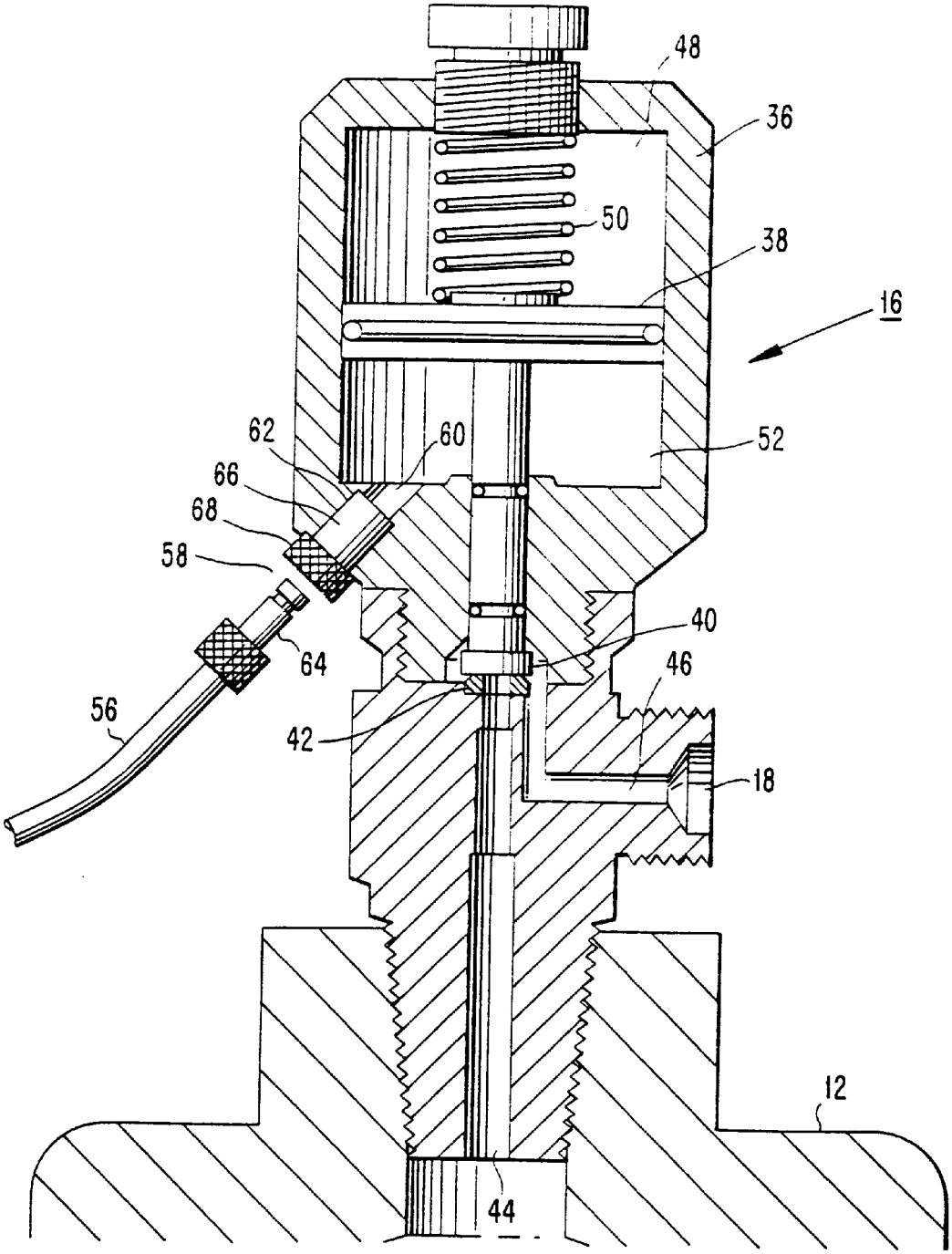
FIG. 2 is a cross-sectional view showing the construction of an air-actuated valve.

The value 16 attached on the gas container 12 is air-actuated. The air-actuated valve 16, to which the present invention can be applied, can be various types, for example a bellows type or a diaphragm type. The valve 16 in this embodiment has a piston type pneumatic actuator 36 as clearly shown in FIG. 2. Namely, the air-actuated valve 16 illustrated here is constructed such that a piston 38 in the pneumatic actuator 36 is caused to move up and down by compressed air, whereby a valve body 40 integrally attached on the piston 38 is engaged with or alienated from a valve seat 42 so as to control a gas stream flowing from the inside of the gas container 12 to the discharge port 18 by way of passages 44, 46. The piston 38 demarcates the interior space of the pneumatic actuator 36 to upper and lower spaces. The upper space 48 has a compression spring 50 disposed therein for pressing downward the piston 38. Thus, the valve body 40 is pressed down onto the valve seat 42 by the spring force of said compression spring 50 in no-loading (when the supply of compressed air is stopped), whereby the valve 16 is maintained under a closed state. When compressed air supplied to the lower space 52 of the pneumatic actuator 36, the piston 38 is moved upward against the spring force of the compression spring 50 to alienate the valve body 40 from the valve seat 42 so that the valve 16 is opened.

The supply of compressed air into the pneumatic actuator 36 of said valve 16 is enabled by connecting an air tube 56 extending from an air supply system 54 to the pneumatic actuator 36. The connection of said air tube 56 to the pneumatic actuator 36 will preferable be carried out by use of a quick joint 58. The illustrated quick joint 58 is one of the type that has been hitherto used, and it is composed of a socket 62 gas-tightly secured on a through hole 60 provided in the lower side wall of the pneumatic actuator 36, and a plug 64 attached on the fore end of said air tube 56. The socket 62 comprises an almost cylindrical socket body 66, into which the plug 64 is to be inserted, and a locking mechanism (not shown) which locks the plug 64 so that the plug 64 is prevented from falling off from the socket body 66 when it is inserted. The locking mechanism may be released from the locked state by sliding a lock-releasing sleeve 68 disposed on the outside of the socket body 66. Further, said socket 62 has a valve mechanism (not shown) provided in its inside, and by virtue of said valve mechanism, it is devised that a passage in the socket 62 is closed as the plug 64 is not inserted, and when the plug 64 is inserted and locked, the passage in the socket 62 is opened.

The air supply system 54 comprises a compressed air supply source 70 and an solenoid-type direction control valve 72. The direction control valve 72 is a three-ports and two-positions type. It is constructed so that in the no-loaded state, when electricity is not fed to the solenoid 74, an inlet port P leading to the compressed air supply source 70 is closed and an outlet port B connected to the air tube 56 is communicated with a discharge port R. When the solenoid 74 of said direction control valve 72 is energized, the inlet port P is brought into communication with the outlet port B and the discharge port R is closed. Accordingly, if the solenoid 74 is energized as the air tube 56 is connected with the valve 16, compressed air is supplied from the compressed air supply source 70 to the lower space 52 of the pneumatic actuator 36 by way of the direction control valve 72 and air tube 56 so that the valve 16 is caused to assume an opened state, as mentioned above. If the supply of electricity to the solenoid 74 is stopped, the directional control valve 72 is returned to the no-loading state so that the interior of the pneumatic actuator 36 is opened to the atmosphere by way of the air tube 56. Hence, the valve 16 is closed by the action of the compression spring 50 in the pneumatic actuator 36. In addition, it is preferred that a silencer 76 is connected to the discharge port R.

The air tube connection state detecting apparatus 10 according to the present invention, which will be applied in the aforementioned construction, has a branch pipe 80 branched from a pipe 78 of the air supply system 54 between the compressed air supply source 70 and the direction control valve 72. At the fore end of said branch pipe 80 is attached a socket (i.e. a to-be-connected member) 82 which is substantially equal to the above-mentioned socket 62. This socket 82 is intended to receive the plug 64 of the air tube 56 detached from the socket 62 of the valve 16 and to hold the same plug 64 at a refuge situation. It is fixed at a proper position in the cylinder cabinet, that is somewhat separate from the gas container 12.

In addition, the branch pipe 80 has a flow restriction (a fixed throttle valve) 84 provided therein. Furthermore, a pressure switch 86 is connected to the branch pipe 80 between the socket 82 and the flow restriction 84. The pressure switch 86 will be switched off when the internal pressure of the branch pipe 80 in the same portion is reduced less than a predetermined value. It is set, in the illustrated embodiment, so as to be turned on in reduction of pressure.

The output signals of the pressure switch 86 will be sent into a microcomputer (a control means) 88. The microcomputer 88 can recognize the connection state of the air tube 56 on the basis of the signals of the pressure switch 86 input therein. In addition, this microcomputer 88 constitutes a control panel 90 for controlling and managing the whole of the gas supply system. It will also be used to control the opening and closing of equipment in the system, for example the shut-off valves 24, 32, 34 and the direction control valve 72, depending on the aforementioned detection results.

Figure 3:
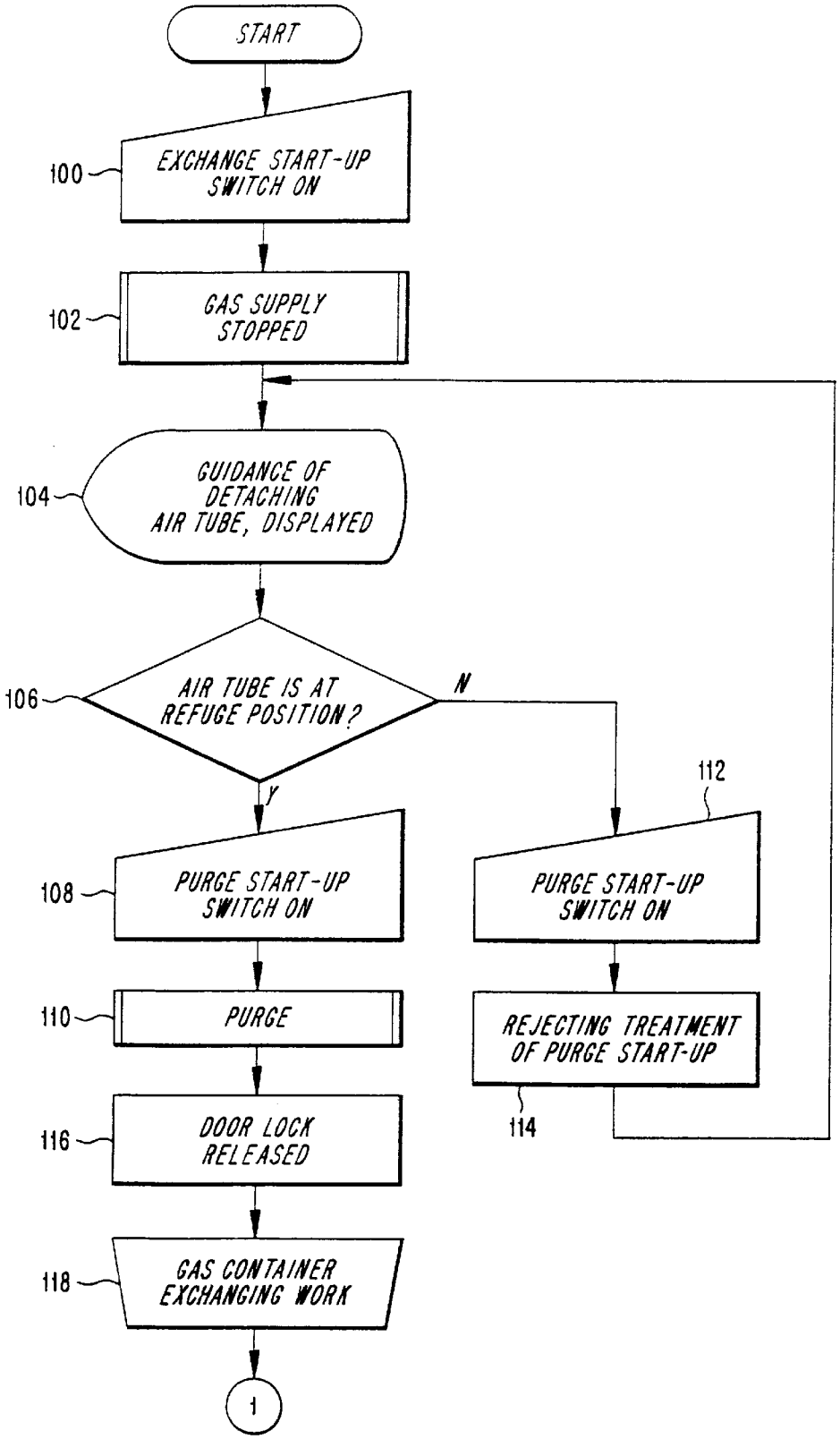
FIG. 3 is a flow chart showing a portion of a program which is put into practice by the microcomputer in the apparatus according to the present invention.

In the aforementioned construction, the operation of the present invention will be described as one example of a gas container-exchanging work, referring to the flow charts of FIG. 3 and FIG. 4. The flow charts of FIG. 3 and FIG. 4 show roughly a program which will be put into practice by the microcomputer 88.

It is assumed that a special material gas is being supplied, before the start-up of the operation, from the gas container 12 into a semiconductor manufacturing unit (not shown). Namely, the plug 64 of the air tube 56 is connected to the socket 62 of the air-actuated valve 16 and locked here. At the same time, the solenoid 74 of the direction control valve 72 in the air supply system 54 is excited and compressed air is supplied to the pneumatic actuator 36 so that the valve 16 is opened. Further, it is assumed that the shut-off valves 32, 34 in the pipes 28, 30 are closed.

When an operator turns on an input device of the control panel 90 (for example an exchanging work start-up switch 92) in order to start up the gas container-exchanging work, the microcomputer 88 first releases the excitation of the solenoid 74 of the direction control valve 72 in the air supply system 54 on the basis of its input signal, thereby stopping the supply of compressed air so that the air-actuated valve 16 is closed. Then, it closes the shut-off valve 24 in the pipe 14 (the steps 100 & 102).

At the same time as the aforementioned control treatment of opening and closing the valves, the microcomputer 88 causes a display unit 94 on the control panel 90 to display a guidance of transferring the plug 64 of the air tube 56 into the socket 82 at a refuge position (the step 104). In accordance with this display, the operator draws out the plug 64 from the socket 62 of the valve 16 and sets it in the socket 82 at the refuge position.

After the plug 16 is connected to the socket 82, the passage of the socket 82 is opened so that the branch pipe 80 and the air tube 56 are in communication with each other. Accordingly, the compressed air flows through the branch pipe 80, air tube 56 and direction control valve 72 in turn from the supply source 70, and then it is discharged to the atmosphere. At that time, the flow restriction 84 reduces the flow rate of the compressed air flowing here. Further, since the passage of the socket 82 is changed from a closed state to an opened state, the internal pressure of the branch pipe 80 is decreased so that the pressure switch 86 is switched over to produce an on signal into the microcomputer 88.

If the signal from the pressure switch 86 is switched over from off to on, the microcomputer 88 recognizes that the air tube 56 is connected to the socket 82 at the refuge position. If the operator turns on a purge start-up switch 96 of the control panel 90 in such a situation, the shut-off valves 32, 34 in the pipes 28, 30 are opened. Accordingly, purge gas is caused to flow through the pipe 28 from the purge gas supply source so that the special material gas existing in the pipe 14 between the valve 16 and the shut-off valve 24 is released from the vent pipe 30 to the atmosphere (the steps 106, 108 & 110). On the other hand, if the signal from the pressure switch 86 is off, it is judged that the plug 64 of the air tube 56 is not connected to the socket 82 at the refuge position. Even if the purge start-up switch 96 is accordingly turned on, the treatment is not started (the steps 112 & 114).

After the purge is carried out for a given period of time or it is detected by a concentration gauge that the concentration of the gas in the line of the gas supply system becomes less than a predetermined value, the microcomputer 88 releases the lock of a gas container-exchanging door of the cylinder cabinet (the step 116). Accordingly, it becomes possible to exchange the gas container 12 (the step 118).

After the exchange of the gas container 12 is completed, the operator turns on a gas-tightness check start-up switch 98 in order to effect a gas-tightness check of the connection part of the respective lines (the step 120). In the prior art, this gas-tightness check step will be automatically started up after the gas-tightness check start-up switch 98 is turned on. However, in the present invention after the same switch is turned on, it is detected again depending on a signal from the pressure switch 86 whether the plug 64 of the air tube 56 is connected to the socket 82 at the refuge position, and if it is judged that the same plug 64 is connected, it will lock the door of the cylinder cabinet and to start up the gas-tightness check step (the steps 122, 124 & 126). In a non-connected state, the plug 64 may be connected with the valve 16. Hence, the gas-tightness check step will not be carried out and the operation will return to step 122, and await the connection of plug 64 to the socket 82 at the refuge position (the step 128).

If the gas-tightness check step is completed, the microcomputer 88 causes the display unit 94 to display a guidance of connecting the air tube 56 to an air-actuated valve 16 of a new gas container 12 (the step 130). On the basis of this display, the operator draws out the plug 64 of the air tube 56 from the socket 82 at the refuge position and inserts it for connection into the socket 62 of the valve 16.

If the plug 64 is detached from the socket 82 at the refuge position, the passage of the socket 82 is closed by means of a valve mechanism in the socket 82 so that the stream of air passing through the branch pipe 80 is stopped. By virtue of this fact, the internal pressure switch 86 is switched over so that an off signal is sent to the microcomputer 88. The microcomputer 88 regards, on the basis of the off signal from the pressure switch 86, that the plug 64 is connected to the socket 62 of the valve 16 (the step 132). Then, the operator turns on the purge start-up switch 96 again, and hence the shut-off valves 32, 34 in the pipes 28, 30 are opened (the steps 134 & 136). Accordingly, the purge gas is permitted to flow in, and the inside of the pipe opened to the atmosphere is cleaned up. On the other hand, if an on signal is not produced from the pressure switch 86, it is judged that the air tube 56 is not connected to the valve 16, and even if the switch 96 is pushed down, the purge is not started up (the steps 138 & 140).

If purging after the gas container exchange is completed, the microcomputer 88 closes the shut-off valves 32, 34 and opens the shut-up valve 24 (the step 142). If compressed air is thereafter supplied to the valve 16 through the air tube 56, the special material gas may be supplied to the semiconductor-manufacturing unit from the gas container 12. Although the gas container-exchanging work has been described above, the aforementioned process is merely one example and it may be variously modified. For instance, a result of recognizing the connection state of the air tube 56 may be displayed in the display unit 94. In a case where it is made a proviso that the air tube 56 is detached, also in works other than the gas container-exchanging work, it is a matter of course that the apparatus according to the present invention can be used for checking said proviso. In addition, also the gas supply system is not limited to one for supplying a special material gas into a semiconductor-manufacturing unit.

In the aforementioned embodiment, the connection of the air tube 56 and the valve 16 is achieved by use of a quick joint. However, the present invention is applicable also to a system where a connection means of another type is used. Further, it is possible to attach a socket at the fore end of the air tube 56 and a plug is disposed in the valve 16. In this case, a plug of the same shape will be disposed as to-be-connected member at the refuge position.

As to a means of detecting that the fore end of the air tube 56 is in the refuge position, there can be conceived various means. For instance, although air is supplied through the branch pipe 80 from the compressed air supply source 70 in the aforementioned embodiment, it may be possible to separately provide another exclusive air supply source as the air supply means and to connect the air tube thereto. Also, as to a means of detecting the flowing of air, there may be used a pressure sensor, a flow rate sensor or the like, not limited to the pressure switch.

As to a means of detecting the connection of an air tube, it may be conceived to use a photoelectric sensor. For instance, a transparent type of photoelectric sensor may be provided on the inner wall surface of the socket 82. The connection state of the air tube may be detected depending on a change in the detection signal produced when the plug 64 is connected to the socket, running cross the photoelectric sensor. If a socket is attached at the fore end of the air tube 56, as mentioned above, a to-be-connected member of the same shape as a plug to be connected to the socket may be provided at the refuge position. The light-projecting part and light-receiving part of a reflex type photoelectric sensor may be formed on the fore end of this to-be-connected member.

This utilizes the fact that a metallic plate in contact with the fore end of a plug exists in the inside of the socket and said plant can reflex light.

If the detecting apparatus according to the present invention is used in a case where an air tube is detached from the air-actuated valve of a gas container so as to close the same valve, as mentioned above, the connection state of the air tube and the valve can be detected. If system maintenance work is carried out on the basis of the detection result in a system using a special material gas such as a silane series gas, accordingly, maintenance work when air tube is connected with the valve can be prevented and hence the safety is remarkably improved.

DESCRIPTION OF REFERENCE NUMERALS

10—air tube connection state detecting apparatus, 12—gas container, 16—air-actuated valve, 54—air supply system, 56—air tube, 58—quick joint, 62—plug, 70—compressed air supply source, 80—branch pipe, 82—socket (a to-be-connected member), 86—pressure switch and 88—microcomputer.

I claim:

1. An air tube connection state detecting apparatus for detecting whether a fore end of an air tube for supplying compressed air to an air-actuated valve for a gas container is connected to said air-actuated valve comprising:

a member, provided at a position separate from said air-actuated valve, to which the fore end of said air tube is to be connected; and a sensor for detecting whether the fore end of said air tube is connected to said member.

2. The air tube connection state detecting apparatus according to claim 1, in which said sensor comprises an air supply for supplying air into said air tube through said member only when the fore end of said air tube is connected to said member, and an air supply detector for detecting whether air is supplied from said air supply.

3. The air tube connection state detecting apparatus according to claim 2, wherein said air supply detector is a pressure sensor, a flow rate sensor or a pressure switch.

4. The air tube connection state detecting apparatus according to claim 1, in which said sensor is a photoelectric sensor.

5. The air tube connection state detecting apparatus according to claim 1, which further comprises:

a controller for controlling said gas container, on the basis of the results detected by said sensor.

6. The air tube connection state detecting apparatus according to claim 1, wherein said air actuated valve is a bellows valve, a diaphragm valve or a piston actuator valve.

* * * * *